US007506699B1

(12) United States Patent
Harvey et al.

(10) Patent No.: US 7,506,699 B1
(45) Date of Patent: Mar. 24, 2009

(54) DIRECTIONAL DRILLING TOOL

(75) Inventors: Michael S. Harvey, P.O. Box 11364, Spring, TX (US) 77391; Riley Garland Pinson, Sugar Land, TX (US); Frank M. Gemmill, Needville, TX (US); William Franck Smith, Spring, TX (US)

(73) Assignee: Michael S. Harvey, Spring, TX (US)

( * ) Notice: Subject to any disclaimer, the term of this patent is extended or adjusted under 35 U.S.C. 154(b) by 0 days.

(21) Appl. No.: 12/037,236

(22) Filed: Feb. 26, 2008

(51) Int. Cl.
*E21B 7/04* (2006.01)

(52) U.S. Cl. ..... 175/61; 175/62; 166/117.5; 166/241.5

(58) Field of Classification Search ..... 166/241.5, 166/117.5; 175/61, 62, 45; 285/404, 90
See application file for complete search history.

(56) References Cited

U.S. PATENT DOCUMENTS 3,052,309 A * 9/1962 Eastman ..... 175/45
5,915,474 A * 6/1999 Buytaert et al. ..... 166/50

* cited by examiner

*Primary Examiner*—David J Bagnell
*Assistant Examiner*—Sean D Andrish
(74) *Attorney, Agent, or Firm*—Buskop Law Group, PC; Wendy Buskop

(57) ABSTRACT

A directional drilling tool comprising an orientation spear point having a spear axis. The orientation spear point comprises an end shaft with a threadable extension disposed along the spear axis and a support pin having a support pin axis perpendicular to and intersecting the spear axis. An orienting pin having an orienting pin axis perpendicular to the support pin axis and spear axis and intersecting the spear axis also extends through the end shaft. A latch rod with a latching edge is connected to the end shaft, and a nose is connected to the latching rod. The directional drilling tool also comprises a crossover sub comprising a first threaded section for engaging the threadable extension, and a second threaded extension for receiving a plurality of pin dimensions, an end of a tool, or a box.

18 Claims, 8 Drawing Sheets

DIRECTIONAL DRILLING TOOL

FIELD

The present embodiments relate to a directional drilling tool for enabling simultaneous steering of a drilling device while obtaining orientation measurements.

BACKGROUND

A need exists for a directional drilling tool that enables steering of mud motors and similar drilling devices by enabling use of a measurement while drilling device that is both retrievable and replaceable.

A further need exists for a directional drilling tool that enables use of a gyroscopic tool simultaneous with drilling, allowing the directional drilling tool to be steered continuously during drilling operations.

A need also exists for a directional drilling tool that enables measurement while drilling devices and gyroscopic tools to be retrieved when drilling tools fail, or replaced when the measurement while drilling devices fail, without requiring removal of the entire drill string or drilling tubular form a well.

The present embodiments meet these needs.

BRIEF DESCRIPTION OF THE DRAWINGS

The detailed description will be better understood in conjunction with the accompanying drawings as follows.

Figure 1:
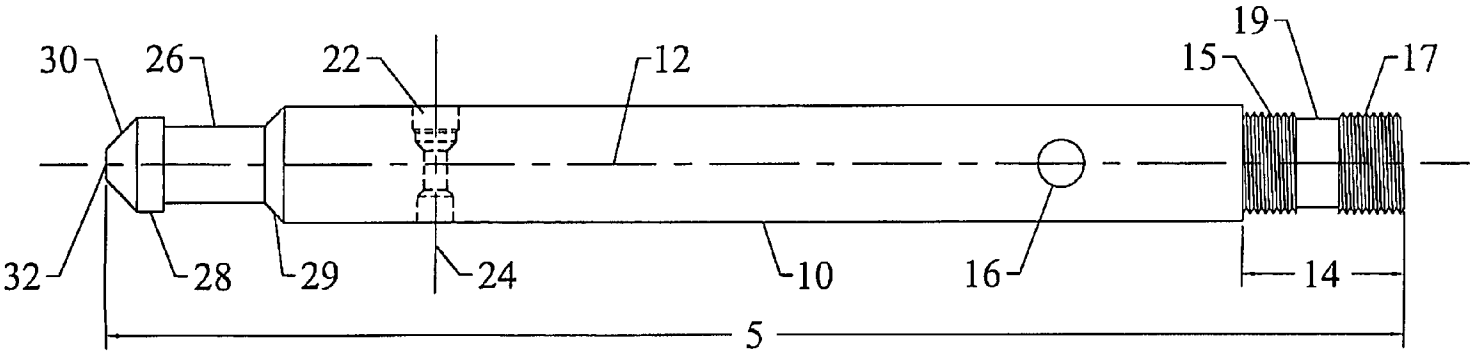
FIG. 1 depicts a side view of an embodiment of an orientation spear point of the present directional drilling tool.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a directional drilling tool.

The present directional drilling tool saves time by enabling a gyroscopic tool to be attached to the directional drilling tool during drilling operations.

Conventional drilling methods use a gyroscopic tool or similar device to establish a suitable angle while maintaining a predetermined direction or azimuth, then remove the gyroscopic tool from a well, insert a measurement while drilling tool into the well, and attempt to drill in the direction determined by the gyroscopic tool.

During removal of the gyroscopic tool, dirt and other particles can enter an orienting sub, requiring cleaning of the sub before a drilling tool can be inserted. Additionally, if the angle of the drilling tool is determined to be unsuitable, the drilling tool must be removed, and the gyroscopic tool reinserted to acquire a more suitable angle.

The present directional drilling tool can determine suitable angles continuously during operation, simultaneous with the drilling process, without removing the gyroscopic tool or any other part of the directional drilling tool from a well.

The directional drilling tool thereby provides a more efficient method of drilling than conventional methods, avoiding the potential for dirt and other particles to enter an orienting sub while removing and inserting tools, and avoiding potential inaccuracies that create a need for repeating measurements when frequently inserting and removing gyroscopic tools from a well.

The present directional drilling tool provides the benefit of continuous measurement during drilling operations, enabling use of both gyroscopic tools and removable, replaceable measurement while drilling devices simultaneous with drilling. This benefit enables extremely accurate, precise drilling operations over conventional tools, which are unable to be oriented with the aid of a gyroscopic tool during drilling.

The present directional drilling tool also provides enhanced accuracy by orienting a drilling device, such as a mud motor, with a measurement while drilling device and a gyroscopic tool, along a single axis. Through use of an internal orienting pin, which orients a mule shoe stinger attached to a gyroscopic tool, and a plurality of locking fasteners which secure a measurement while drilling device and a drilling tool along a single axis, the reliability and accuracy of the obtained measurements is increased.

The accuracy of the present directional drilling tool obtained by aligning each component along a single axis saves time when drilling, which can be an extremely costly commodity. Additionally, misalignment of drilling equipment can cause inaccuracies in drilling operations, which can result in costly equipment damage, requiring great time and expense to replace or repair damaged components.

A further advantage of the present directional drilling tool is that the directional drilling tool enables potentially expensive measurement while drilling devices to be retrieved from a well without removing drilling tubulars, motors, bottom hole assemblies, and similar drilling equipment.

Conventional drilling methods insert measurement while drilling devices into larger-diameter well components, requiring entire drilling units to be removed when a measurement while drilling device requires repair or replacement, consuming large quantities of time and creating a great financial expense. Additionally, when drilling equipment becomes damaged or stuck in a well, it is often impossible to retrieve extremely expensive measurement while drilling devices from the well The present directional drilling tool enables measurement while drilling devices to be removed and/or replaced without requiring removal and reinsertion of other drilling equipment. A conventional retrieval tool can be used to engage a latching edge of the present directional drilling tool to retrieve the measurement while drilling device.

Alternatively, a retrieving mule shoe stinger having a J-latch can be used to engage an internal orienting pin of the directional drilling tool. The retrieving mule shoe stinger can be used to retrieve the measurement while drilling device, as well as insert a replacement measurement while drilling device, without requiring removal and reinsertion of other well equipment. This retrieval and reinsertion method provides a significant advantage over conventional drilling tools, which do not enable retrieval of measurement while drilling devices simultaneous with steering.

The present directional drilling tool thereby saves time and reduces drilling costs by combining the advantages of enhanced accuracy through enabling simultaneous use of a gyroscopic tool during drilling, and enabling retrieval and insertion of measurement while drilling equipment at any time during the drilling process, even when drill pipe or other equipment becomes stuck.

The present directional drilling tool includes an orientation spear point having a spear axis, and a crossover sub.

The orientation spear point has an end shaft. The end shaft is contemplated to be a solid cylinder, having an outer diameter ranging from 0.8 inches to 1.3 inches and a length ranging from 6.5 inches to 12.0 inches. In an embodiment, the end shaft has an outer diameter of 1.232 inches and a length of 10.335 inches.

The end shaft can be made from any non-magnetic metal alloy, such as stainless steel brass, nickel, silver, or inconel. In an embodiment, the end shaft is made from 316SR or 17-4PH heat treated stainless steel.

The end shaft has a threadable extension disposed along the spear axis. The threadable extension can range from 1.5 to 1.9 inches in length. In an embodiment, the threadable extension has a length of 1.735 inches. It is contemplated that in an embodiment, the threadable extension can have a length of 4.0 inches or longer for receiving a jam nut, locking ring, or similar locking means for securing the crossover sub to the threaded extension.

The threadable extension has threads for engaging a complementary threaded section of the crossover sub. The threadable extension can have a diameter ranging from 0.6 inches to 1.5 inches. In an embodiment, the threadable extension can have a major diameter of 0.990 inches and a minor diameter of 0.890 inches, having 1"-12 UNF threads.

The threadable extension can be made from the same material as the end shaft, or a different material.

The end shaft also has a support pin disposed through the end shaft. The support pin has a support pin axis that intersects and is substantially perpendicular to the spear axis. The support pin is contemplated to engage and support an orienting mule shoe stinger and prevent rotational movement of the mule shoe stinger while engaged with the mule shoe stinger, enabling equipment attached to the mule shoe stinger to remain oriented with the spear axis.

The support pin is contemplated to be a solid stainless steel cylinder and can have a length ranging from 1.75 inches to 2.125 inches and a diameter ranging from 0.4 inches to 0.6 inches. In an embodiment, the support pin has a length of 1.9 inches and a diameter of 0.5 inches. The length of the support pin can be selected to extend slightly beyond the outer diameter of the end shaft for engaging an orienting mule shoe, while not exceeding a length that would interfere with drilling operations.

It is contemplated that the support pin could be made from a harder material than the end shaft to enhance resistance to abrasion and corrosion. For example, the end shaft could be made from 316SR stainless steel, while the support pin is made from a stronger alloy of stainless steel.

In an embodiment, the support pin can be pressed into the end shaft and can be removable and replaceable from the end shaft when worn or damaged.

The end shaft also has an orienting pin disposed through the end shaft. The orienting pin has an orienting pin axis that is substantially perpendicular to both the support pin axis and the spear axis. The orienting pin axis intersects the spear axis.

The orienting pin is contemplated to be disposed through a bore that includes multiple round concentric shafts, with optional tapered bores there between, the shafts having outer diameters ranging from 0.250 inches to 0.500 inches.

The orienting pin can have a length ranging from 1.0 inches to 1.4 inches. In an embodiment, the orienting pin has a length of 1.185 inches and is counter-sunk into one side of the end shaft.

It is contemplated that the orienting pin can be a two-piece construction. A first pin section having a threaded portion can be inserted into the bore. The first pin section is contemplated to have a shoulder that protrudes from the exterior of the end shaft for engaging a mule shoe stinger. A second pin section having a fastener can be inserted into the opposite side of the bore for threading to the threaded portion of the first pin section through the end shaft and aligning the two pin sections along the orienting pin axis. It is contemplated that in an embodiment, the second pin section can be counter-sunk within the end shaft.

The orienting pin is contemplated to orient one or more mule shoe stingers that are inserted into the orientation spear point by causing an inserted mule shoe stinger to rotate such that equipment attached to the mule shoe stinger becomes aligned with the spear axis.

The orienting pin can be made from the same material as the support pin, or a different material. It is contemplated that the orienting pin can be removable from the orientation spear point and replaceable, such as when the orienting pin becomes worn from numerous insertions of mule shoe stingers.

The orientation spear point also has a latch rod connected to the end shaft. The latch rod is contemplated to be cylindrical in shape, having a length ranging from 0.9 inches to 1.2 inches and an outer diameter ranging from 0.7 inches to 1.0 inches. In an embodiment, the latch rod has a length of 1.095 inches and an outer diameter of 0.810 inches.

The latch rod has a latching edge, to which latching means from an overshot or other retrieving tool can be secured. The latching edge can have dimensions selected to accommodate the latching means of a latch retrieving tool. In an embodiment, the latching edge can have a length of 0.300 inches and a diameter of 1.000 inch.

In a contemplated embodiment, a shoulder can be formed between the latching edge and the end shaft. The shoulder can taper at an angle that conforms to a corresponding latch retrieving tool. In an embodiment, the shoulder can have a length of 0.422 inches and can taper at an angle of about 45 degrees.

The orientation spear point has a nose connected to the latch rod. The nose can include a blunt face, which can be a flat face or a round face, substantially perpendicular to the spear axis. The nose can taper along its length at an angle. The nose can have a diameter ranging from 0.2 inches to 1.0 inches and a length ranging from 0.2 inches to 0.4 inches. In an embodiment, the nose has a diameter of 1.000 inches at its base, a diameter of 0.375 inches at its face, a length of 0.325 inches, and tapers at an angle of 45 degrees.

The nose and the latch rod can be made from the same material as the end shaft, or a different non-magnetic metal alloy.

The orientation spear point can be a one-piece construction. It is also contemplated that the end shaft, the latch rod, and the nose can be welded together, threaded together, connected using fasteners, or combinations thereof, to facilitate shipping or replacement of parts if necessary.

In a contemplated embodiment, the orientation spear point can have an intermediate shaft disposed between the end shaft and the latch rod. The intermediate shaft is contemplated to be a solid cylinder and can have a length ranging from 2.4 to 2.8 inches and an outer diameter ranging from 1.0 inch to 1.4 inches. In an embodiment, the intermediate shaft has a length of 2.615 inches and an outer diameter of 1.185 inches. In this embodiment, the end shaft could have a length of 7.145 inches.

The intermediate shaft is contemplated to be useful for engagement with selected overshots or other retrieval tools. The outer diameter of the intermediate shaft can be selected to match the outer diameter of an overshot useable to retrieve the orientation spear point from a well.

The orientation spear point could then have a latching rod with an outer diameter that conforms to a first type of retrieval tool, while the intermediate shaft has an outer diameter that conforms to a second type of retrieval tool, enabling the present directional drilling tool to be adaptable and versatile, able to be retrieved by a wider variety of retrieval tools.

In a contemplated embodiment, a shoulder can be formed between the end shaft and the intermediate shaft. The shoulder can have a length ranging from 0.3 inches to 0.7 inches and can taper at an angle ranging from 1 degree to 10 degrees. In an embodiment, the shoulder has a length of 0.575 inches and tapers at an angle of 2 degrees. The taper and dimensions of the shoulder can be selected to conform to a retrieval tool.

It is also contemplated that, in an embodiment, a shoulder can be formed between the intermediate shaft and the latch rod. The shoulder can taper at an angle selected to conform to the dimensions of a latch retrieval tool. In an embodiment, the shoulder has a length of 0.215 inches and tapers at an angle of 45 degrees.

The intermediate shaft can be made from the same material as the end shaft, or a different non-magnetic metal alloy.

The crossover sub of the present directional drilling tool includes a first threaded section and a second threaded section. The crossover sub is contemplated to be cylindrical in shape, and can have a length ranging from 4 to 8 inches and an outer diameter ranging from 0.75 to 2.25 inches. In an embodiment, the crossover sub has a length of 6.010 inches and an outer diameter of 1.875 inches.

The crossover sub can have a shoulder, tapered at an angle, between the first threaded section and the orientation spear point. The tapered shoulder can range in length from 0.2 inches to 0.5 inches. In an embodiment, the tapered shoulder has a length of 0.350 inches and tapers at an angle of 45 degrees. The tapered shoulder of the crossover sub is contemplated to prevent sticking of the present directional drilling tool in a well and to prevent damage to the orientation spear point and crossover sub from washing by turbulent particles during drilling.

The first threaded section has threads that are complementary to the threadable extension of the orientation spear point, for engaging the threadable extension. The outer diameter of the first threaded section is selected to enable engagement with the threadable extension. In an embodiment, the diameter of the first threaded section can range from 1.0 inch to 2.0 inches, having 1"-12 UPI thread. It is also contemplated that the first threaded extension can have a length of 4.0 inches or more for receiving a locking ring, jam nut, or similar locking means for securing the first threaded section to the threadable extension.

In an embodiment, the first threaded section can have a shoulder formed between the first threaded section and the orientation spear point. The shoulder can include a tapered portion and a straight cylindrical portion. In an embodiment, the straight cylindrical portion has a length of 0.350 inches, and the tapered portion has a length of 0.420 inches. It is contemplated that the shoulder can accommodate an O-ring or similar seal between the orientation spear point and the crossover sub.

The length of the first threaded section can be selected to conform with the threadable extension, for enabling engagement with the threadable extension. It is contemplated that the length of the first threaded section can range from 2.0 inches to 2.5 inches. In an embodiment, the length of the first threaded section is 2.375 inches.

In a contemplated embodiment, the first threaded section can have a plurality of self-locking, orienting fasteners, such as set screws having a diameter of 0.470 inches, for securing the first threaded section to the threadable extension of the orientation spear point. The self-locking, orienting fasteners ensure that the threads of the first threaded section and threadable extension do not become disengaged during drilling operations, which can produce turbulence and torque on the threads.

It is also contemplated that, in an embodiment, in addition to the plurality of self-locking, orienting fasteners, the first threaded section can include an additional securing fastener, such as a locking nut or jam nut, for further securing the first threaded section to the threadable extension. In this embodiment, the threadable extension and the first threaded section are contemplated to have a length sufficient to both engage one another and accommodate the additional securing fastener.

It is contemplated that four self-locking, orienting fasteners can be positioned approximately 90 degrees apart, equidistant around the first threaded section. The threadable extension of the orientation spear point can include a gap for receiving the self-locking, orienting fasteners.

The crossover sub can also have a second threaded section, which has threads for receiving a plurality of pin dimensions, an end of a tool, a box, or a similar item. The plurality of pin dimensions can have differing pin counts, thread counts, major diameters, minor diameters, or combinations thereof. The second threaded section can be a male or a female threaded connection.

In an embodiment, a pin, screw, or similar securing means can be drilled or otherwise inserted into the crossover sub to further secure the second threaded section to a tool or similar piece of equipment.

It is contemplated that the present direct drilling tool can include multiple crossover subs having substantially identical first threaded sections and differing second threaded sections for engagement with a variety of tools and equipment. A crossover sub having a second threaded section suitable for engaging a desired tool can be engaged with the threadable extension, then removed and exchanged with another crossover sub having a differing second threaded section when engagement with a different tool is desired.

It is contemplated that the second threaded extension can have a length ranging from 2.5 inches to 3.2 inches. In an embodiment, the second threaded extension has a length of 2.750 inches.

In an embodiment, the crossover sub can lack a second threadable extension, and can instead be a one-piece construction with a stabilizing shaft. The stabilizing shaft can have threads or other means for securing to a measurement while drilling device or a similar piece of equipment.

In a contemplated embodiment, the crossover sub can be made from non-magnetic metal alloys, such as stainless steel, brass, nickel, silver, inconel, or other similar non-magnetic materials. The crossover sub can be made from the same material as the orientation spear point, or from a different material, such as a material selected to match a connecting tool to prevent galling.

The crossover sub, first threaded extension, and second threaded extension can be a one-piece construction. It is also contemplated that the crossover sub, first threaded extension, and second threaded extension can be connected by welding, threads, or fasteners, to form the crossover sub.

An orienting mule shoe stinger, having a shaft and a cut end, can be inserted over the orientation spear point. It is contemplated that as the cut end of the orienting mule shoe stinger is inserted past the orienting pin, the protruding shoulder of the orienting pin causes the orienting mule shoe stinger to rotate, thereby orienting equipment attached to the orienting mule shoe stinger, such as a gyroscopic tool with the spear axis.

When the orienting mule shoe stinger is fully inserted, the cut end engages each end of the support pin and a slot in the shaft engages the orienting pin. Both the support pin and the orientation pin prevent rotational motion of the orienting mule shoe stinger during drilling operations, thereby retaining the orientation of the attached equipment with the spear axis.

The shaft of the orienting mule shoe stinger can have a length ranging from 12 inches to 20 inches and a diameter ranging from 1.6 inches to 2.0 inches. In an embodiment, the shaft can have a length of about 18.750 inches and a diameter of 1.860 inches. The cut end of the orienting mule shoe stinger can have a length ranging from 2.0 to 4.0 inches. In an embodiment, the cut end is 3.250 inches in length. A slot for engaging the orienting pin can be disposed directly behind the cut end and can have a length selected to conform to the distance between the orienting pin and the support pin in the end shaft. In an embodiment, the slot can have a length of 7.045 inches.

A retrieving mule shoe stinger having a J-latch can also be inserted into the orientation spear point for enabling retrieval of the orientation spear point and an attached measurement while drilling device. As the cut end of the retrieving mule shoe stinger is inserted past the orienting pin, the retrieving mule shoe stinger rotated to align with the spear axis.

The J-latch of the retrieving mule shoe stinger is contemplated to engage the orienting pin, enabling a wireline or similar device connected to the retrieving mule shoe stinger to be used to retrieve the orientation spear point from a well.

The retrieving mule shoe stinger can also be used to insert an orientation spear point with a measurement while drilling device by lowering the orientation spear point into a well using the retrieving mule shoe stinger, then disengaging the J-latch from the orienting pin.

Referring now to FIG. 1, a side view of an embodiment of the orientation spear point is depicted.

The orientation spear point (5) is depicted having an end shaft (10) connected a threadable extension (14) and a latch rod (26). The latch rod (26) is connected to a nose (30).

The orientation spear point (5) has a spear axis (12), along which the end shaft (10), the threadable extension (14), the latch rod (26), and the nose (30) extend.

The total length of the depicted embodiment of the orientation spear point (5) is contemplated to be approximately 14.000 inches, and the outer diameter of the depicted orientation spear point (5) ranges from 0.375 inches at the nose (30) to 1.232 inches at the end shaft (10).

The end shaft (10) is depicted as a solid stainless steel cylinder having a contemplated length of 10.335 inches and an outer diameter of 1.232 inches.

A support pin (16) is shown disposed through the end shaft (10). The support pin (16) is depicted as a solid stainless steel cylinder having a contemplated outer diameter of 0.500 inches. The support pin (16) has a support pin axis (not visible in FIG. 1) that is perpendicular to the spear axis (12) and intersects the spear axis (12). The depicted support pin is contemplated to have a length of approximately 1.9 inches.

A threadable extension (14) is shown connected to the end shaft (10). The threadable extension (14) is depicted having a first threaded segment (15) and a second threaded segment (17) separated by a gap (19). The gap (19) is contemplated to receive self-locking, orienting fasteners from a complementary threaded portion of a crossover sub (not depicted in FIG. 1).

The depicted embodiment of the threadable extension (14) is has a contemplated length of about 1.735 inches. The first threaded segment (15) has a contemplated length of 0.585 inches. The second threaded segment (17) has a contemplated length of 0.685 inches. Both the first threaded segment (15) and second threaded segment (17) are depicted to show a major diameter of 0.990 inches, a minor diameter of 0.890 inches, and 1"-12 UNF threads.

The gap (19) is shown having a contemplated length of 0.470 inches and a diameter of 0.910 inches.

The threadable extension (14) can be made from stainless steel or another similar durable, non-magnetic material.

An orienting pin (22) is shown disposed through the end shaft (10). The orienting pin (22) has an orienting pin axis (24) which is substantially perpendicular to both the support pin axis (not visible in FIG. 1) and the spear axis (12). The orienting pin axis (24) intersects the spear axis (12).

The orienting pin (22) is depicted disposed through a plurality of connected cylindrical and tapered bores which can range in diameter from about 0.250 inches to about 0.500 inches, and which are depicted in greater detail in FIG. 6. The orienting pin (22) has a contemplated length of approximately 1.185 inches.

A latch rod (26) is shown connected to the end shaft (10). A latch shoulder (29) is depicted formed between the end shaft (10) and the latch rod (26). The latch shoulder (29) depicted in FIG. 1 has a contemplated length of approximately 0.422 inches and a taper of about 45 degrees. It is contemplated that the taper of the latch shoulder (29) can be selected to conform to the latching means of a latch retrieving tool.

The latch shoulder (29) has a contemplated diameter of 1.232 inches where connected to the end shaft (10) and a diameter of 0.810 inches where connected to the latch rod (26).

The latch rod (26) is depicted as a solid stainless steel cylinder which can have a length of approximately 1.090 inches and an outer diameter of approximately 0.810 inches. The latch rod (26) has a latching edge (28) opposite the intermediate shaft (20).

The latching edge (28) is depicted as a cylindrical steel edge having a contemplated length of approximately 0.300 inches and a diameter of approximately 1.000 inches. It is contemplated that the diameter of the latching edge (28) can be selected to conform to the latching means of one or more latch retrieving tools. FIG. 1 depicts the latching edge forming a 90 degree shoulder with the latch rod (26).

The latch rod (26) is shown connected to a nose (30) having a blunt face (32). The blunt face (32) is substantially perpendicular to the spear axis (12).

The depicted embodiment of the nose (30) has a contemplated length of approximately 0.325 inches. The nose (30) is shown having a contemplated diameter of 1.000 inches where connected to the latching edge (28) of the latch rod (26), and a diameter of 0.375 inches at the blunt face (32).

The nose (30) is depicted tapering at an angle of approximately 45 degrees between the latching edge (28) and the blunt face (32). The tapering angle of the nose (30) can be selected to conform to the latching means of a latch retrieving tool.

Figure 2:
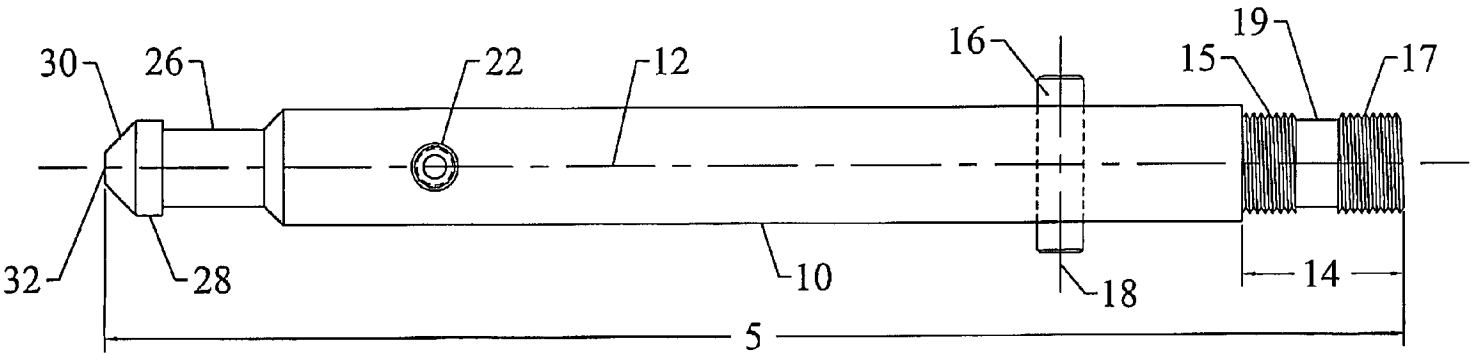
FIG. 2 depicts a ninety degree rotation of the orientation spear point of FIG. 1.

Referring now to FIG. 2, FIG. 2 depicts a ninety degree rotation of the orientation spear point (5) of FIG. 1 having the spear axis (12).

The orientation spear point (5) is shown having the end shaft (10) connected to the threadable extension (14) and the latch rod (26). The latch rod (26) is shown connected to the nose (30).

The latch shoulder (29) is shown formed between the end shaft (10) and the latch rod (26).

The nose (30) is shown having a blunt face (32). The threadable extension (14) is shown having a first threaded portion (15), a second threaded portion (17), and a gap (19).

The orienting pin (22) is shown disposed through the end shaft (10).

The support pin (16) is shown disposed through the end shaft (10). FIG. 2 depicts the support pin (16) having a support pin axis (18), which is substantially perpendicular to the orienting pin axis (not visible in FIG. 2) and the spear axis (12). The support pin axis (18) intersects the spear axis (12).

Figure 3:
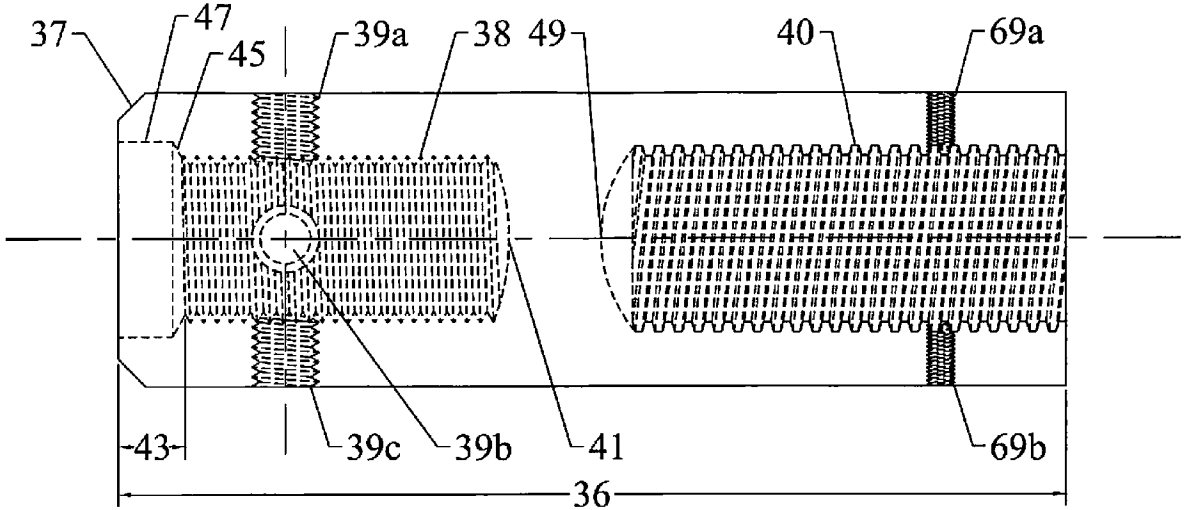
FIG. 3 depicts a side view of an embodiment of a crossover sub of the present directional drilling tool.

Referring now to FIG. 3, a side view of an embodiment of a crossover sub (36) is depicted.

The crossover sub (36) is depicted as a stainless steel cylinder which can be approximately 6.010 inches in length, with an outer diameter of 1.875 inches. The crossover sub (36) is depicted having a sub shoulder (37), which has a contemplated length of about 0.350 inches and can taper at an angle of approximately 45 degrees to an outer diameter of about 1.525 inches.

The crossover sub (36) is shown having a first threaded section (38) disposed therein. The first threaded section (38) is contemplated to have a length and outer diameter selected to engage with the threadable extension (14, depicted in FIG. 1).

FIG. 3 depicts the first threaded section (38) having a first counterbore (41) and a section shoulder (43) with a tapered portion (45) and a straight portion (47). The first threaded section (38) is contemplated to have a length of approximately 1.955 inches. The first counterbore (41) is shown having a length of approximately 0.100 inches. In an embodiment, the first threaded extension (38) could be longer for accommodating an additional securing means, such as a locking ring or a jam nut.

The tapered portion (45) is depicted having a contemplated length of approximately 0.070 inches and a taper of about 45 degrees. The straight portion (47) is shown having a contemplated length of approximately 0.350 inches and a diameter of approximately 1.245 inches. The section shoulder (43) can be used to accommodate an O-ring or similar sealing means.

A first self-locking orienting fastener (39*a*), a second self-locking orienting fastener (39*b*), and a third self-locking orienting fastener (39*c*) are visible engaging the first threaded portion (38) at a distance approximately 1.060 inches from the outer edge of the sub shoulder (37).

It is contemplated that each self-locking orienting fastener (39*a-c*) is positioned along the length of the first threaded section (38) such that when the first threaded section (38) engages the threadable extension (14, depicted in FIG. 1), each self-locking orienting fastener (39*a-c*) engages the gap (19, depicted in FIG. 1) of the threadable extension (14, depicted in FIG. 1). It is also contemplated that an additional securing means, such as a locking ring or jam nut, could be attached to the first threaded section (38) to further secure the first threaded section (38) to the threadable extension (14, depicted in FIG. 1).

Each self-locking orienting fastener (39*a-c*) is spaced equidistantly, approximately 90 degrees apart, around the circumference of the first threaded section (38). It is contemplated that a fourth self-locking orienting fastener (not visible in FIG. 3) engages the first threaded section (38) opposite the second self-locking orienting fastener (39*b*) and substantially perpendicular to the first self-locking orienting fastener (39*a*) and third self-locking orienting fastener (39*c*).

The self-locking orienting fasteners (39*a-c*) are depicted as set screws, which can have an approximate diameter of 0.470 inches and a length sufficient to engage the gap (19, depicted in FIG. 1) of the threadable extension (14, depicted in FIG. 1). In an embodiment, the self-locking orienting fasteners (39*a-c*) can have a length of 0.875, however the length of the self-locking orienting fasteners (39*a-c*) can vary depending on the dimensions of the crossover sub (36).

The crossover sub (36) is also depicted having a second threaded section (40). The second threaded section (40) is contemplated to have a length, diameter, and thread size selected to engage a desired pin dimension, end of a tool, or box. The second threaded section (40) is shown having a second counterbore (49). It is also contemplated that an additional securing fastener (69*a* and 69*b*), such as a locking ring or jam nut, can be attached to the second threaded section (40).

It is contemplated that the second threaded section (40) can have a length of approximately 2.750 inches, and the second counterbore (49) can have a length of approximately 0.200 inches.

Figure 4:
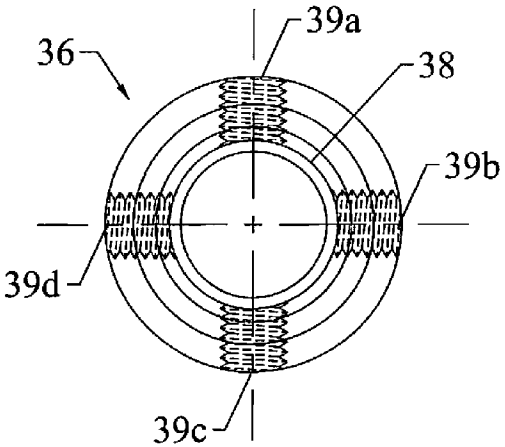
FIG. 4 depicts a top view of the crossover sub of FIG. 3.

Referring now to FIG. 4, a top view of the crossover sub (36) of FIG. 3 is shown.

The crossover sub (36) is depicted having the first threaded section (38).

FIG. 4 depicts the first self-locking orienting fastener (39*a*) engaging the first threaded section (38). The second self-locking orienting fastener (39*b*) engages the first threaded section (38) substantially perpendicular to the first self-locking orienting faster (39*a*).

The third self-locking orienting fastener (39*c*) is shown engaging the first threaded section (38) opposite the first self-locking orienting fastener (39*a*) and perpendicular to the second self-locking orienting fastener (39*b*).

A fourth self-locking orienting fastener (39*d*) is shown engaging the first threaded section (38) substantially perpendicular to the first self-locking orienting fastener (39*a*) opposite the second self-locking orienting fastener (39*b*).

Figure 5:
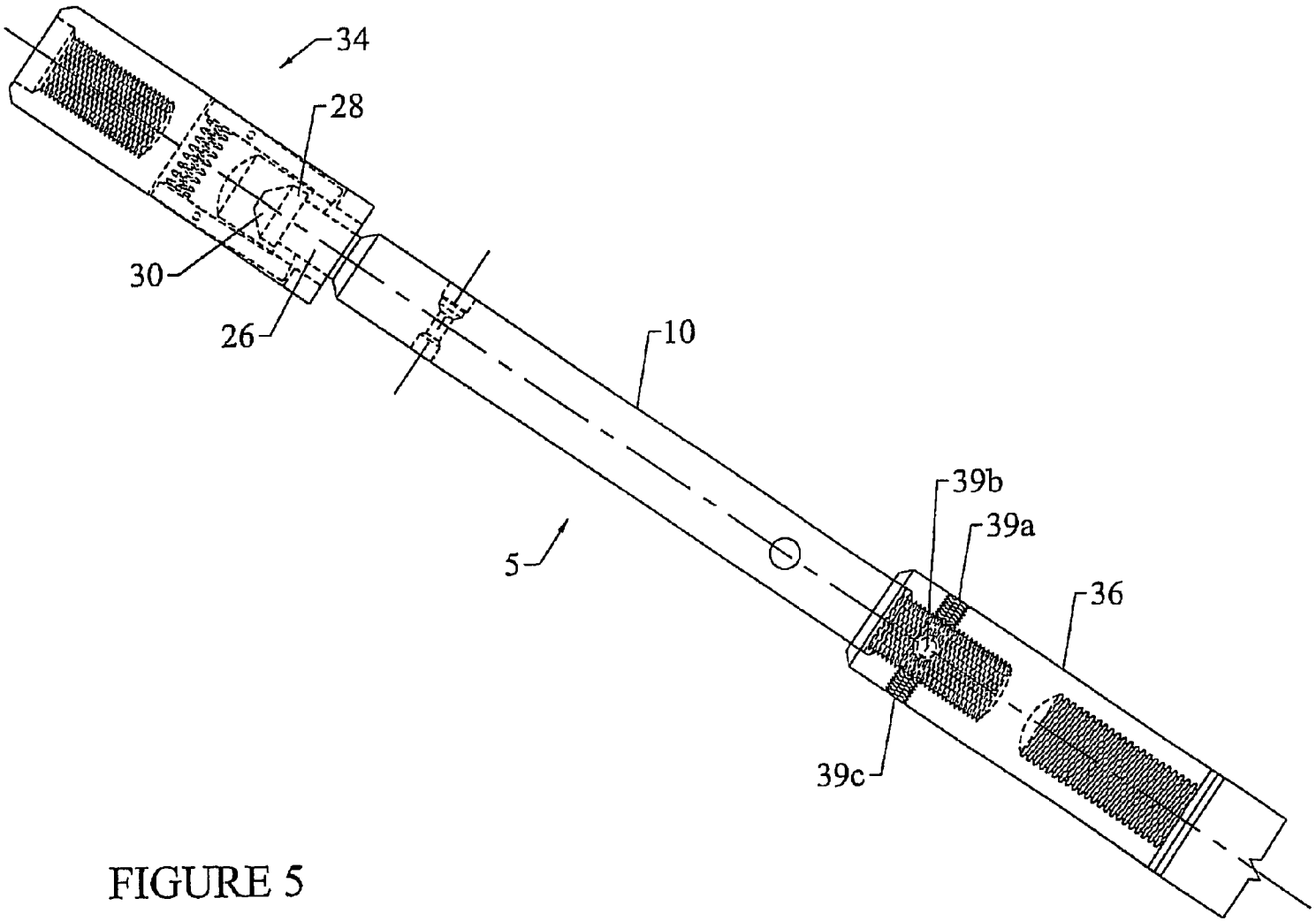
FIG. 5 depicts an embodiment of an orientation spear point engaged with an embodiment of a crossover sub and a latch retrieval tool.

Referring now to FIG. 5, an orientation spear point (5) is shown threadably engaged with a crossover sub (36).

The orientation spear point (5) is shown having the end shaft (10) connected to the latch rod (26), which is connected to the nose (30). The threadable extension (14, not visible in FIG. 5) is engaged with the first threaded section of the crossover sub (36)

The crossover sub (36) is shown having the first threaded section engaged with the threadable extension (14). The first self-locking orienting fastener (39*a*), the second self-locking orienting fastener (39*b*), and the third self-locking orienting fastener (39*c*) are shown securing the first threaded section crossover sub (36) to the orientation spear point (5). Each self-locking orienting fastener (39*a-c*) is contemplated to engage the gap (19, depicted in FIG. 1).

A retrieval tool (34) is shown engaging the latching edge (28) of the latch rod (26).

Figure 6A:
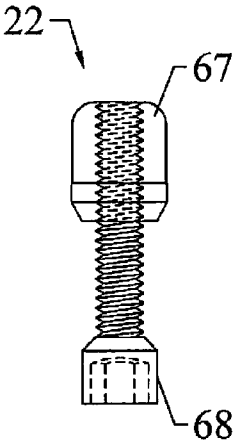
FIGS. 6A and 6B depict side views of an orienting pin within the orientation spear point.
Figure 6B:
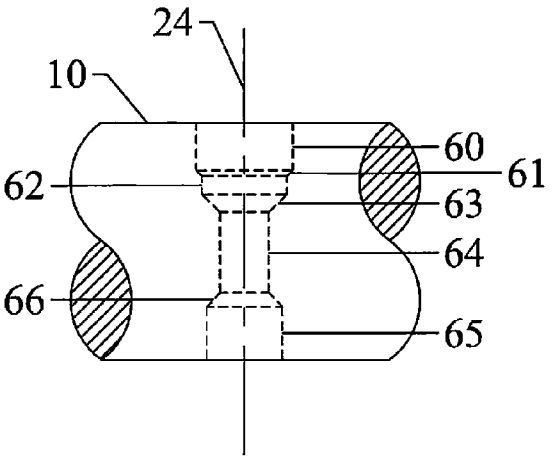

Referring now to FIGS. 6A and 6B, side views of the orienting pin (22) are shown. The orienting pin (22) is shown having a first pin section (67) which is contemplated to protrude from the end shaft (10) when inserted, to orient a mule shoe stinger. A second pin section (68) is used to fasten the first pin section (67) by threading to the first pin section (67) through a bore in the end shaft (10) and centralizing the orienting pin (22) along the orienting pin axis (24).

The orienting pin (22) is depicted having a length greater than the diameter of the end shaft (10). It is contemplated that the orienting pin (22) can have a length of approximately 1.185 inches.

The end shaft (10) is depicted having a plurality of bores for receiving the orienting pin (22). A first bore (60), is shown as cylindrical bore having a contemplated length of about 0.250 inches and a diameter of about 0.500 inches.

A second bore (62) is shown connected to the first bore (60). A first tapered bore (61) is formed between the first bore (60) and the second bore (62). The first tapered bore (61) is contemplated to have a length of approximately 0.280 inches and a taper of about 45 degrees.

The second bore (62) is depicted as a cylinder and can have a length of approximately 0.115 inches and a diameter of about 0.440 inches.

The second bore (62) is shown connected to a third bore (64). A second tapered bore (63) is formed between the second bore (62) and the third bore (64). The second tapered bore (63) is contemplated to have a length of about 0.095 inches and a taper of about 45 degrees.

The third bore (64) is depicted as a cylinder having a contemplated length of about 0.370 inches and a diameter of about 0.250 inches. The third bore (64) is shown connected to a fourth bore (65).

A third tapered bore (66) is shown formed between the third bore (64) and the fourth bore (65). The third tapered bore (66) can have a length of approximately 0.070 inches and a taper of about 45 degrees.

The fourth bore (65) is depicted as a cylinder having a contemplated length of approximately 0.275 inches and a diameter of about 0.390 inches.

The configuration of pin sections within the plurality of bores is contemplated to allow the orienting pin (22) to protrude from the exterior of the end shaft (10) to impart rotational motion to a mule shoe stinger that is inserted over the end shaft (10) past the orienting pin (22), thereby aligning equipment attached to the mule shoe stinger with the spear axis of the orientation spear point.

Figure 7A:
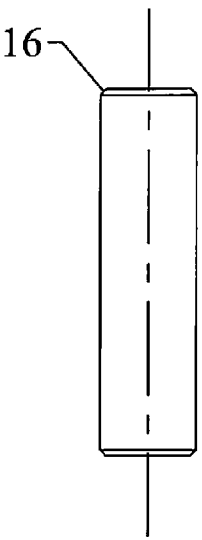
FIGS. 7A and 7B depict side views of a support pin within the orientation spear point.
Figure 7B:
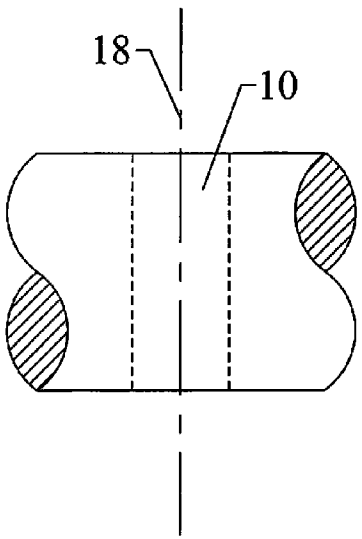

Referring now to FIGS. 7A and 7B, side views of a support pin (16) within the end shaft (10) are shown.

The support pin (16) is depicted as a solid stainless steel cylinder having a contemplated length of approximately 1.90 inches and a diameter of approximately 0.500 inches. Each end of the support pin (16) engages the end shaft (10). It is contemplated that the support pin (16) can be pressed in to install the support pin (16) into the end shaft (10) along the support pin axis (18).

In a contemplated embodiment, the support pin (16) can be removable and replaceable, enabling new support pins to be inserted when the support pin (16) becomes worn or damaged.

The support pin (16) is contemplated to engage a cut end of a mule shoe stinger at two opposite points of the exterior of the end shaft (10), preventing rotational motion of the mule shoe stinger during drilling operations, thereby maintaining the orientation of equipment attached to the mule shoe stinger with respect to the spear axis of the orientation spear point.

Figure 8:
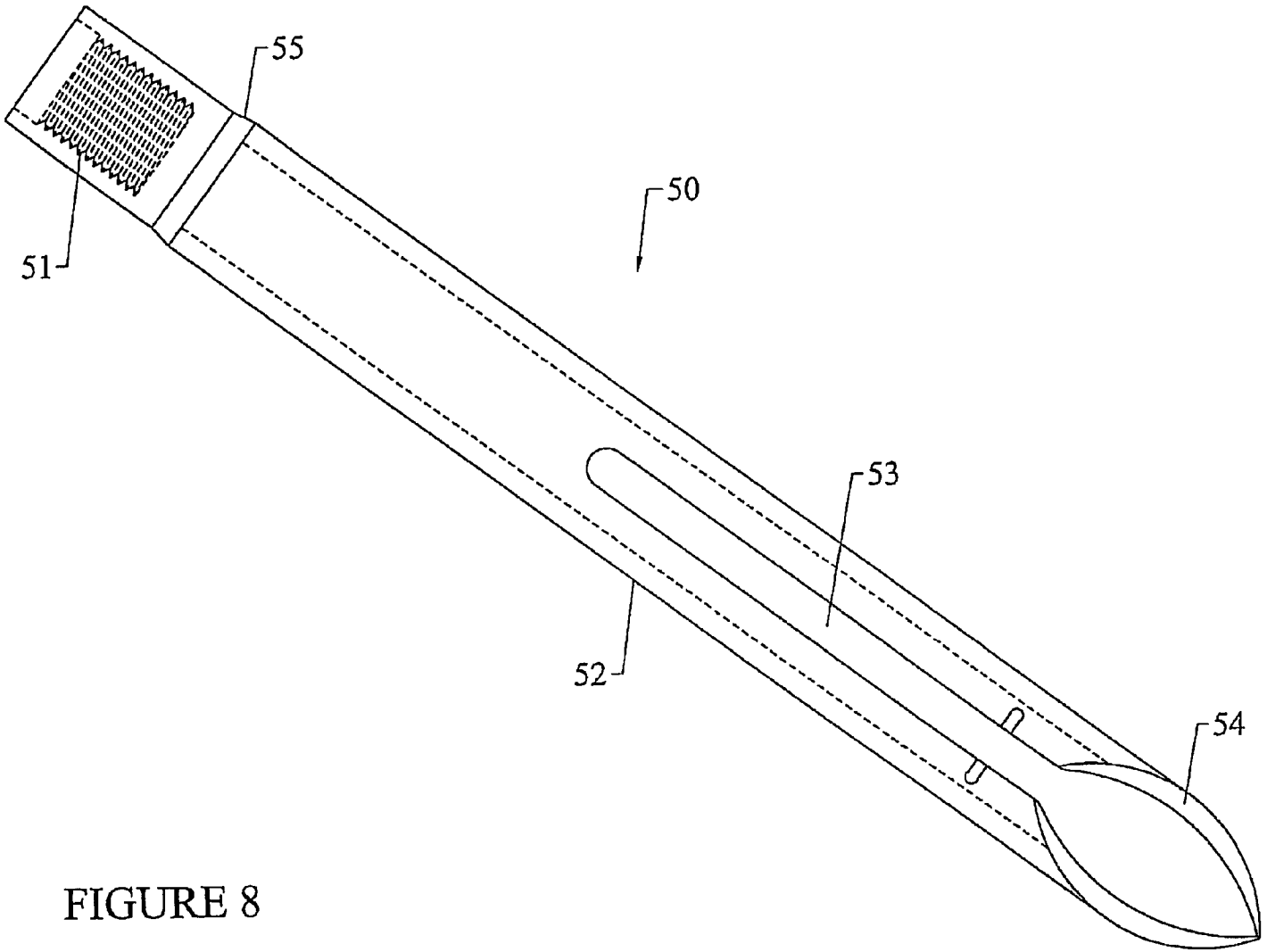
FIG. 8 depicts a top view of an embodiment of an orienting mule shoe stinger.

Referring now to FIG. 8, a top view of an embodiment of an orienting mule shoe stinger (50) is shown.

The orienting mule shoe singer (50) has a shaft (52) connected to a cut end (54). The shaft (52) is depicted as a steel cylinder having a contemplated length of 12.925 inches and a diameter of 1.860 inches. The cut end (54) can have a length of 3.250 inches.

The orienting mule shoe stinger (50) is also shown having a threaded engagement (51), which can be engaged with measuring equipment, such as a gyroscopic tool. A stinger shoulder (55) is shown formed between the shaft (52) and the threaded engagement (51). The shoulder is contemplated to have a length of 0.300 inches and a taper angle of 11 degrees.

The threaded engagement (51) has a contemplated length of about 1.875 inches, a major diameter of about 1.355 inches, and a minor diameter of about 1.130 inches. In an embodiment, the threaded engagement (51) can include a locking mechanism, such as one or more set screws, a locking ring, a jam nut, or similar locking means, for securing a gyroscopic tool or other device to the orienting mule shoe stinger (50).

It is contemplated that when the orienting mule shoe stinger (50) is inserted over the orientation spear point (depicted in FIG. 1), the cut end (54) engages the orienting pin (depicted in FIG. 1), which imparts rotational movement to the orienting mule shoe stinger (50), thereby orienting equipment secured to the threaded engagement (51) with the spear axis of the orientation spear point.

The orienting mule shoe stinger (50) is depicted having a slot (53) which is contemplated to engage the orienting pin when the orienting mule shoe stinger (50) is inserted into the orientation spear point. The support pin (depicted in FIG. 1) of the orientation spear point is contemplated to engage the cut end (54) when the orienting mule shoe stinger (50) is fully inserted into the orientation spear point, preventing rotational movement of the orienting mule shoe stinger (50) during drilling operations. The combined support of orienting mule shoe stinger (50) by the orienting pin and the support pin, simultaneously, provides both a longitudinal and a lateral axis of support to the orienting mule shoe stinger (50). The orienting pin and the support pin equally share the force exerted on the orienting mule shoe stinger (50). The longitudinal extension of the support pin provides superior support against rotational torque compared to the orienting pin alone.

The orienting mule shoe stinger (50) can be made from stainless steel, or another durable, non-magnetic material. In an embodiment, the orienting mule shoe stinger (50) can be made from a non-magnetic ferrous material.

Figure 9:
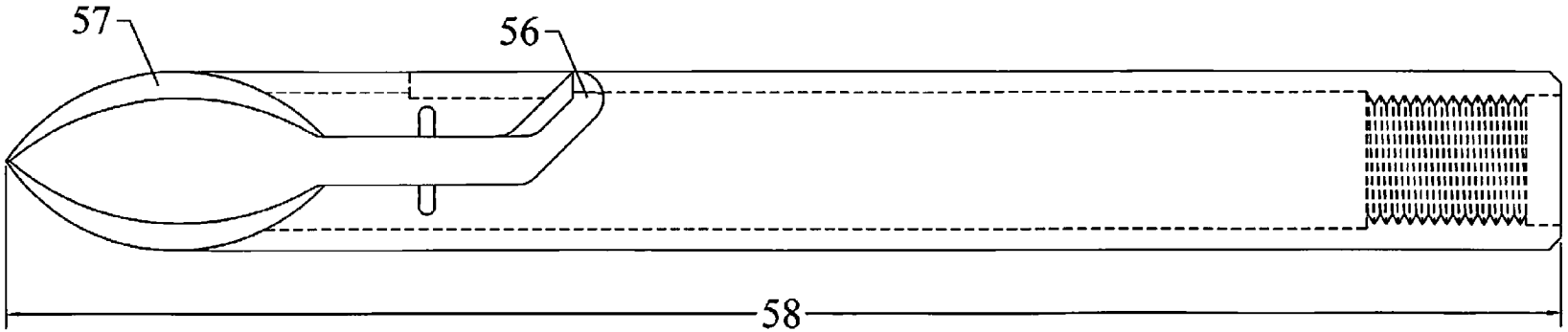
FIG. 9 depicts a top view of an embodiment of a retrieving mule shoe stinger.

Referring now to FIG. 9, a top view of an embodiment of a retrieving mule shoe stinger (58) is depicted.

The retrieving mule shoe stinger (58) has a contemplated length of approximately 17.000 inches and a diameter of about 1.875 inches.

The retrieving mule shoe stinger (58) has a retrieving cut end (57) and a J-latch (56). The retrieving cut end (57) can have a length of about 3.500 inches. It is contemplated that when the retrieving mule shoe stinger (58) is inserted into the orientation spear point, the retrieving cut end (57) engages the orienting pin, which provides rotational movement to the retrieving mule shoe stinger (58) such that the J-latch (56) engages the orienting pin.

When the J-latch (56) is engaged with the orienting pin, the retrieving mule shoe stinger (58) can be used to retrieve the orientation spear point from a well, such as by using a wireline attached to the J-latch (56).

It is contemplated that the retrieving mule shoe stinger (58) can also be used to insert an orientation spear point into a well.

Figure 10B:
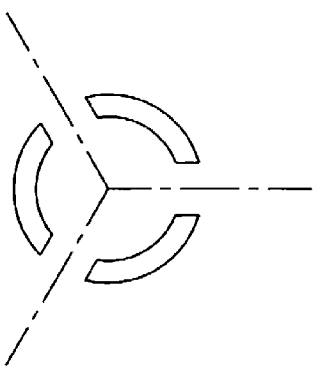
FIGS. 10A and 10B depict top views of a J-latch of the retrieving mule shoe stinger of FIG. 9.
Figure 10A:
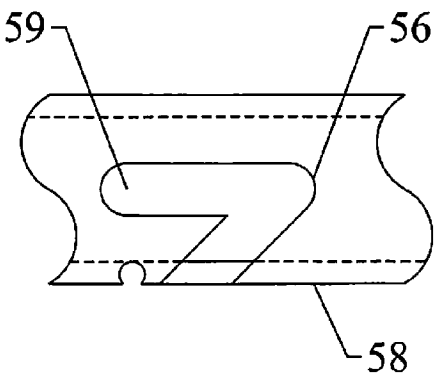

Referring now to FIGS. 10A and 10B, side views of the J-latch (56) of FIG. 9 are shown.

The J-latch (56) is depicted within the retrieving mule shoe stinger (58), having a latching portion (59) with a contemplated length of about 1.990 inches, for engaging the orienting pin. It is contemplated that after the orienting pin engages the J-latch (56), the orienting pin can enter the latching portion (59) when the retrieving mule shoe stinger (58) is pulled from a well, such as by using a wireline.

Figure 11:
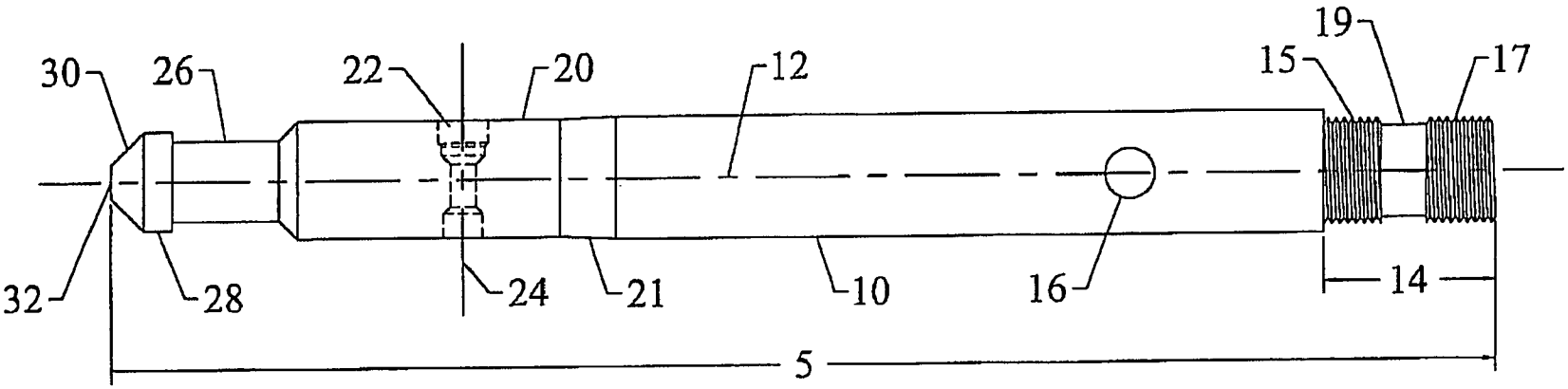
FIG. 11 depicts an alternate embodiment of the orientation spear point of FIG. 1.

Referring now to FIG. 11, a side view of an alternate embodiment of the orientation spear point is depicted.

The orientation spear point (5) is depicted having an end shaft (10) connected a threadable extension (14) and an intermediate shaft (20). The intermediate shaft (20) is connected to a latch rod (26), which is in turn connected to a nose (30).

The orientation spear point (5) has a spear axis (12), along which the end shaft (10), the threadable extension (14), the intermediate shaft (20), the latch rod (26), and the nose (30) extend.

The end shaft (10) is depicted as a solid stainless steel cylinder having a length of 7.145 inches and an outer diameter of 1.232 inches.

A support pin (16) is shown disposed through the end shaft (10). The support pin (16) is depicted as a solid stainless steel cylinder having a contemplated outer diameter of 0.500 inches. The depicted support pin is contemplated to have a length of approximately 1.9 inches.

A threadable extension (14) is shown connected to the end shaft (10). The threadable extension (14) is depicted having a first threaded segment (15) and a second threaded segment (17) separated by a gap (19).

The depicted embodiment of the threadable extension (14) can have a length of about 1.735 inches. The first threaded segment (15) has a contemplated length of 0.585 inches. The second threaded segment (17) has a contemplated length of 0.685 inches. Both the first threaded segment (15) and second threaded segment (17) can have a major diameter of 0.990 inches and a minor diameter of 0.890 inches.

The gap (19) is contemplated to have a length of 0.470 inches and a diameter of 0.910 inches.

The intermediate shaft (20) is shown connected to the end shaft (10). An intermediate shoulder (21) is formed between the end shaft (10) and the intermediate shaft (20). FIG. 11 depicts the intermediate shoulder (21) having a contemplated length of approximately 0.575 inches and a taper of 2 degrees. The depicted intermediate shoulder (21) can have a diameter of 1.232 inches where connected to the end shaft (10), and a diameter of 1.185 inches where connected to the intermediate shaft (20).

The length and outer diameter of the intermediate shaft (20) and the intermediate shoulder (21) can be selected to conform to one or more retrieving tools, to facilitate retrieval of the orientation spear point (5).

The intermediate shaft (20) is depicted as a solid stainless steel cylinder and is contemplated to have a length of approximately 2.615 inches and an outer diameter of 1.185 inches. The outer diameter of the intermediate shaft (20) is contemplated to be selected to correspond to the diameter of an overshot or similar retrieving tool.

An orienting pin (22) is shown disposed through the intermediate shaft (20). The orienting pin (22) has an orienting pin axis (24) which is substantially perpendicular to both an axis of the support pin (16) and the spear axis (12). The orienting pin axis (24) intersects the spear axis (12).

The orienting pin (22) is can have a length of approximately 1.185 inches, and can be disposed through a bore having a diameter of about 0.250 inches at its thinnest point, and a diameter of about 0.500 inches at its thickest point.

A latch rod (28) is shown connected to the intermediate shaft (20). A latch shoulder (29) is depicted formed between the intermediate shaft (20) and the latch rod (28). FIG. 1 depicts the latch shoulder (29) having a contemplated length of approximately 0.215 inches and a taper of about 45 degrees. It is contemplated that the taper of the latch shoulder (29) can be selected to conform to the latching means of a latch retrieving tool.

The latch shoulder (29) can have a diameter of 1.185 inches where connected to the intermediate shaft (20) and a diameter of 0.810 inches where connected to the latch rod (26).

The latch rod (26) is depicted as a stainless steel cylinder having a contemplated length of approximately 1.090 inches and an outer diameter of approximately 0.810 inches. The latch rod (26) has a latching edge (28) opposite the intermediate shaft (20).

The latching edge (28) is depicted as a cylindrical steel edge and can have a length of approximately 0.300 inches and a diameter of approximately 1.000 inches. It is contemplated that the diameter of the latching edge (28) can be selected to conform to the latching means of one or more latch retrieving tools.

The latch rod (26) is shown connected to a nose (30) having a blunt face (32). The blunt face (32) is substantially perpendicular to the spear axis (12).

The depicted embodiment of the nose (30) can have a length of approximately 0.325 inches. The nose (30) can have a diameter of 1.000 inches where connected to the latching edge (28) of the latch rod (26), and a diameter of 0.375 inches at the blunt face (32).

The nose (30) is depicted tapering at an angle of approximately 45 degrees between the latching edge (28) and the blunt face (32). The tapering angle of the nose (30) can be selected to conform to the latching means of a latch retrieving tool.

Figure 12:
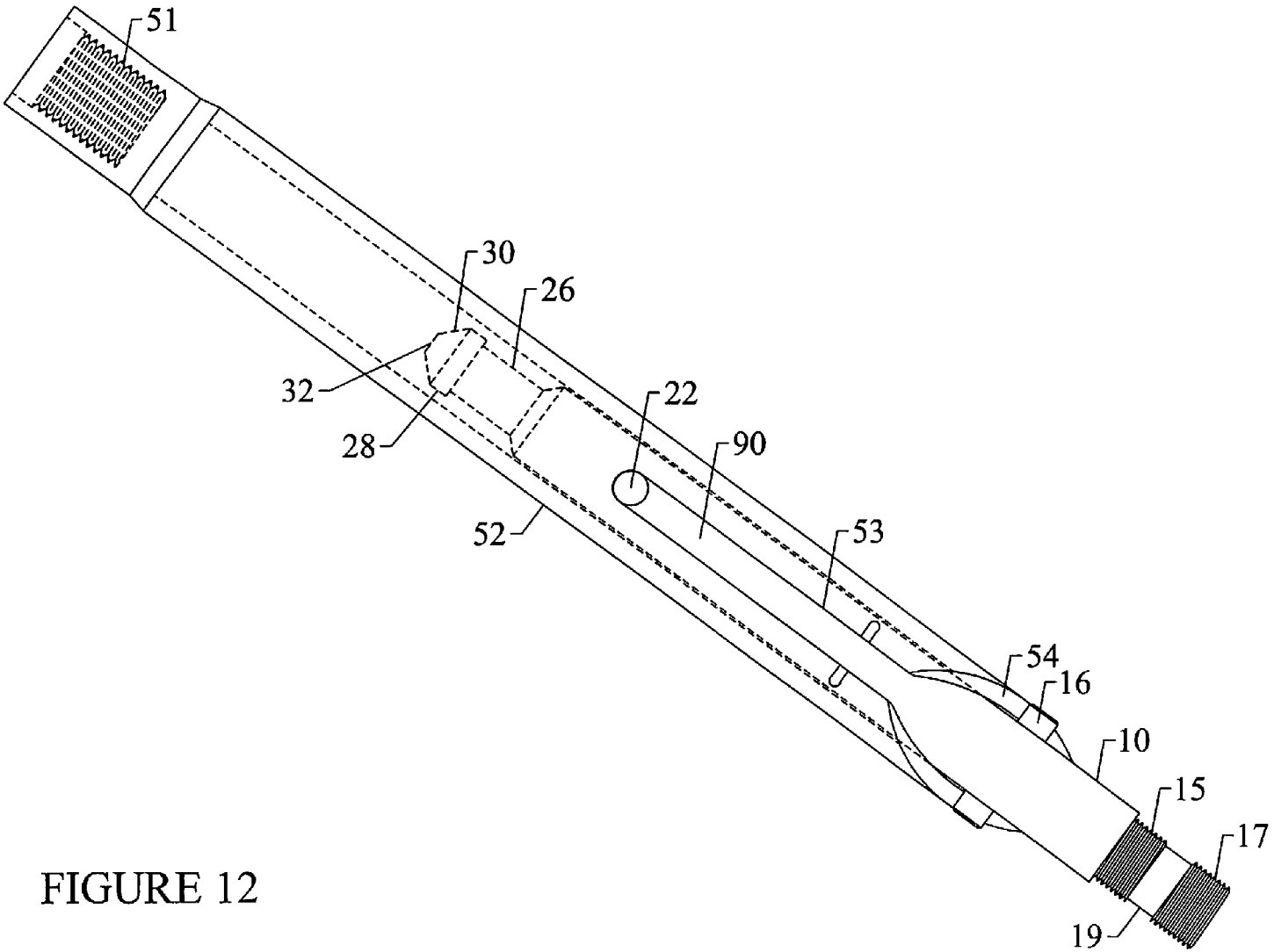
FIG. 12 depicts an embodiment of the orientation mule shoe stinger and the orientation spear point of the invention.

FIG. 12 depicts an embodiment of the orientation mule shoe stinger and the orientation spear point of the invention.

The orienting mule shoe stinger (depicted in FIG. 8) can be placed over the orientation spear point (depicted in FIG. 1), the cut end (54) can engage the orienting pin (22) (best depicted in FIG. 6A), which can impart rotational movement to the orienting mule shoe stinger, with the spear axis of the orientation spear point, thus creating a tool face (90).

The orienting mule shoe stinger is depicted having a slot (53) which is contemplated to engage the orienting pin (22) when the orienting mule shoe stinger is placed over the orientation spear point. The support pin (16) of the orientation spear point is contemplated to engage the cut end (54) when the orienting mule shoe stinger is fully inserted over the orientation spear point, preventing rotational movement of the orienting mule shoe stinger during drilling operations. The combined support of orienting mule shoe stinger by the orienting pin and the support pin, simultaneously, provides both a longitudinal and a lateral axis of support to the orienting mule shoe stinger. The orienting pin and the support pin equally share the force exerted on the orienting mule shoe stinger. The longitudinal extension of the support pin (16) provides superior support against rotational torque compared to the orienting pin alone.

While these embodiments have been described with emphasis on the embodiments, it should be understood that within the scope of the appended claims, the embodiments might be practiced other than as specifically described herein.

What is claimed is:

1. A directional drilling tool comprising:

an orientation spear point having a spear axis, wherein the orientation spear point comprises:

an end shaft comprising a threadable extension disposed along the spear axis, a support pin having a support pin axis, and an orienting pin having an orienting pin axis, wherein the support pin axis is substantially perpendicular to the orienting pin axis and the spear axis, wherein the orienting pin axis is substantially perpendicular to the support pin axis and the spear axis, and wherein the orienting pin axis and the support pin axis intersect the spear axis;

a latch rod with a latching edge; and a nose;

wherein the threadable extension comprises a first threaded segment separated from a second threaded segment by a gap;

a crossover sub comprising:

a first threaded section for engaging the threadable extension; and a second threaded section for receiving a plurality of pin dimensions, an end of a tool, or a box;

wherein the crossover sub comprises a plurality of self-locking orientated fasteners for contacting the gap of the threadable extension, each self-locking orientated fastener having an axis perpendicular to the axis of the crossover sub and the axis of the orientation spear point.

2. The directional drilling tool of claim 1, further comprising a shoulder formed between the end shaft and the latch rod at an angle that conforms to a corresponding latch retrieving tool.

3. The directional drilling tool of claim 1, wherein the crossover sub comprises an outer diameter ranging from 0.75 inches to 2.25 inches.

4. The directional drilling tool of claim 1, wherein the orientation spear point, the crossover sub, or combinations thereof, are made from non-magnetic metal alloys.

5. The directional drilling tool of claim 4, wherein the non-magnetic metal alloys comprise stainless steel, brass, nickel, silver, inconel, or combinations thereof.

6. The directional drilling tool of claim 1, further comprising an orienting mule shoe comprising a shaft and a cut end, wherein the shaft engages the orienting pin and the cut end engages the support pin.

7. The directional drilling tool of claim 1, further comprising a retrieving mule shoe comprising a J-latch, wherein the J-latch engages the orienting pin.

8. The directional drilling tool of claim 1, wherein the nose comprises a blunt face substantially perpendicular to the spear axis.

9. The directional drilling tool of claim 1, wherein the first threaded section further comprises an additional securing fastener.

10. The directional drilling tool of claim 1, wherein the plurality of pin dimensions have different pin counts, different thread counts, different sized major diameters, different sized minor diameters, or combinations thereof.

11. The directional drilling tool of claim 2, wherein the angle that conforms to the corresponding latching retrieving tool tapers at about forty-five degrees.

12. The directional drilling tool of claim 1, wherein the orienting pin comprises a first pin section having a shoulder for engaging a mule shoe stinger and a second pin section comprising a fastener for securing the first pin section through a bore in the end shaft.

13. The directional drilling tool of claim 1, further comprising a seal disposed between the orientation spear point and the crossover sub.

14. A directional drilling tool comprising:

an orientation spear point having a spear axis, wherein the orientation spear point comprises:

an end shaft comprising a threadable extension disposed along the spear axis and a support pin having a support pin axis, wherein the support pin axis is substantially perpendicular to and intersects the spear axis;

an intermediate shaft comprising an orienting pin having an orienting pin axis, wherein the orienting pin axis is substantially perpendicular to the support pin axis and the spear axis, and wherein the orienting pin axis intersects the spear axis;

a latch rod with a latching edge; and a nose;

wherein the threadable extension comprises a first threaded segment separated from a second threaded segment by a gap;

a crossover sub comprising:

a first threaded section for engaging the threadable extension; and a second threaded section for receiving a plurality of pin dimensions, an end of a tool, or a box;

wherein the crossover sub comprises a plurality of self-locking orientated fasteners for contacting the gap of the threadable extension, each self-locking orientated fastener having an axis perpendicular to an axis of the crossover sub and the axis of the orientation spear point.

15. The directional drilling tool of claim 14, further comprising a shoulder formed between the intermediate shaft and the latch rod at an angle that conforms to a corresponding latch retrieving tool.

16. The directional drilling tool of claim 14, further comprising a shoulder formed between the intermediate shaft and the end shaft.

17. The directional drilling tool of claim 14, wherein a diameter of the intermediate shaft conforms to a corresponding retrieving tool.

18. The directional drilling tool of claim 16, wherein the shoulder tapers at an angle that conforms to a corresponding retrieving tool.

* * * * *